United States Patent [19]

Brown et al.

[11] Patent Number: 4,815,406

[45] Date of Patent: Mar. 28, 1989

[54] COMPOUND STITCH PATTERN FOR A SEWING MACHINE

[75] Inventors: John Brown, Wilton, Conn.; John W. Wurst, Chester Township, Morris County, N.J.

[73] Assignee: SSMC Inc., Shelton, Conn.

[21] Appl. No.: 142,162

[22] Filed: Jan. 11, 1988

[51] Int. Cl.[4] ..... D05B 3/02

[52] U.S. Cl. ..... 112/447; 112/121; 112/454

[58] Field of Search ..... 112/447, 454, 121, 453, 112/458

[56] References Cited

U.S. PATENT DOCUMENTS

| | | | |
|---|---|---|---|
| 4,184,441 | 1/1980 | Brown et al. | 112/447 X |
| 4,570,561 | 2/1986 | Makabe et al. | 112/454 |
| 4,622,907 | 11/1986 | Kimura | 112/454 X |

*Primary Examiner*—Peter Nerbun

*Attorney, Agent, or Firm*—Robert E. Smith

[57] ABSTRACT

An electronic sewing machine storing information concerning a string of different stitch patterns includes a central processor responsive to an operator entered parameter for effecting unique modification of certain stored stitch patterns thus creating a compound stitch pattern useful, for instance, as a mending stitch pattern for repairing various length fabric tears.

2 Claims, 2 Drawing Sheets

COMPOUND STITCH PATTERN FOR A SEWING MACHINE

BACKGROUND OF THE INVENTION

1. Field of the Invention

This invention relates to sewing machines of the type adapted to produce a variety of stitch patterns, and more particularly, to an arrangement in a sewing machine of the above character for executing a compound stitch pattern comprising a sequence of different stitch patterns each of which is capable of unique response to a single control parameter introduced by a sewing machine operator prior to initiation of production of said compound stitch pattern.

A specific application of this invention involves the provision of a compound stitch pattern for mending a fabric tear, the compound mending stitch pattern includes a sequence of different stitch pattern extending transversely and lengthwise of the fabric tear, certain of which are capable of unique response to an operator entered parameter related to the length of the fabric tear so as to provide a composite stitch pattern matching the fabric tear to be mended 2. Description of the Prior Art U.S. Pat. No. 4,373,459 of W. H. Dunn et al for "Electronically Controlled Sewing Machine Arranged to Sew a Sequence of Stitch Patterns" issued Feb. 15, 1983 discloses an arrangement for stringing together a sequence of different stitch patterns on a sewing machine. Although in this patent each pattern in the string may be modified by an operator introduced modification factor, each such modification must be separately introduced at the time each pattern in the string is selected so that the formulation of a compound stitch pattern would be so tedious and time U.S. Pat. No. 4,184,441 of J. Brown et al. for "Electronically Controlled Household Sewing Machine Having Patch Sewing Capability" issued Jan. 22, 1980 discloses an arrangement for sequentially sewing successively different stitch configurations which might provide a compound stitch pattern useful for mending or the like but in this patent each successively different stitch configuration must be selected by the sewing machine operator during the stitching of the sequence, thus imposing a further critical timing requirement on the successful execution of a compound stitch pattern.

SUMMARY OF THE INVENTION

The formulation of a compound stitch pattern in a sewing machine is provided for in this invention by an arrangement for successively executing a sequence of different stitch patterns stored in a sewing machine memory with each different stitch pattern being capable of unique modification in accordance with a single parameter entered by the machine operator into the memory.

One object of this invention is to provide a compound stitch pattern suitable for mending a fabric tear and comprising a variety of different stitch patterns stored in the sewing machine memory so as to be executed in predetermined sequence with certain of the stored stitch patterns being uniquely modified responsive to a single operator entered parameter related to the length of the fabric tear to be mended thus automatically to adjust the stored patterns to produce a variant of the compound stitch pattern suitable to repair the length of fabric tear indicated by the operator indicated parameter.

A further object of this invention is to provide means for inhibiting the sewing of a selected compound stitch pattern of the above character until entry has been effected by the sewing machine operator of a parameter to which certain of the stitch patterns are responsive.

DESCRIPTION OF THE DRAWINGS

The above and additional objects and advantages will be apparent from the following description of a preferred embodiment illustrated in the accompanying drawings in which.

DESCRIPTION OF THE PREFERRED EMBODIMENT

Figure 1:
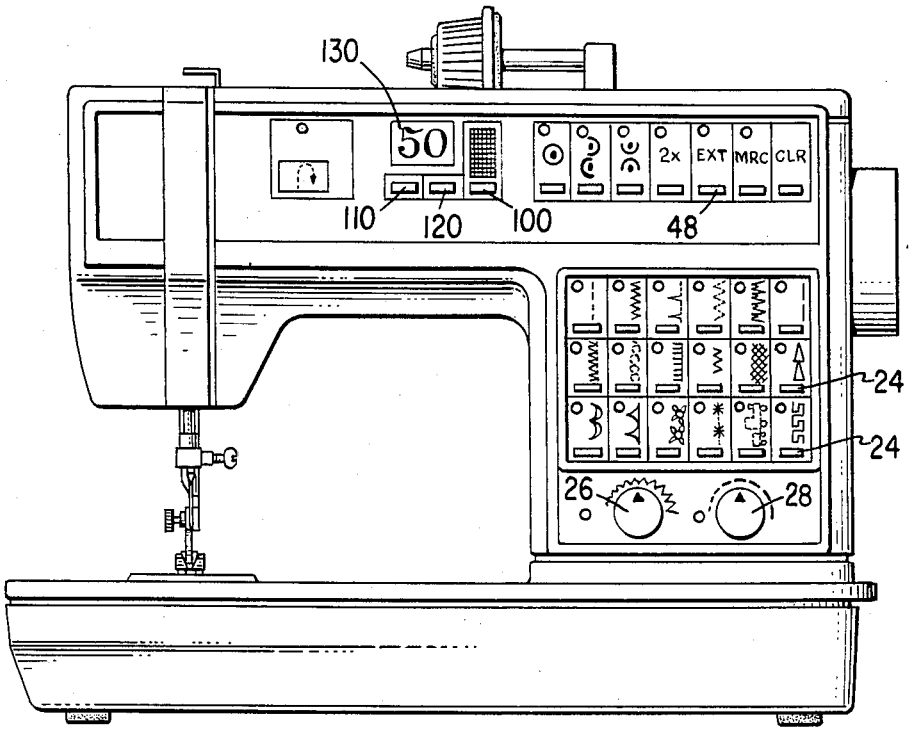
FIG. 1 is a front elevational view of a sewing machine having this invention applied thereto.

The sewing machine illustrated in FIG. 1 is of the type disclosed in the U.S. Pat. No. 4,373,459, Feb. 15, 1983, which is incorporated herein by reference. This sewing machine includes the capability of sewing successively a series, or string, of stitch patterns selected by a sewing machine operator from a repertoire of stitch patterns. The patterns may be selected by depressing the appropriate pattern selector switch 24 and then entered into the string of patterns to be successively stitched by depression of the enter button 48. Pattern modifying factors, such as pattern width or length, may be entered for each selected pattern by setting and depression of the appropriate override control elements 26 or 28 all in accordance with the detailed teaching in the above referenced U.S. patent.

The present invention differs from that of the referenced U.S. Pat. No. 4,373,459 in that a selector switch 100 is provided for entering into the sewing machine memory 66 instructions for an entire sequence of stitch patterns which are preferrably predetermined in relation to one another to produce a compound stitch pattern such as a mending stitch pattern illustrated in FIG. 2 and described herein below.

Preferrably, selection of the compound stitch pattern by depression of the selector switch 100 enters the string of predetermined stitch patterns of the compound stitch pattern into the sewing machine memory 66 independently of and disassociated from any patterns selected by depression of the pattern selector switches 24, so that operation of the sewing machine thereafter will terminate after production of the compound stitch pattern without joining therewith any conventionally selected string of patterns. Such independent execution of the compound stitch pattern may be attained by entering the component stitch patterns thereof in a memory having stringing capability but separate from that of the conventional string memory of the sewing machine.

The present invention also differs from that of the referenced U.S. Pat. No. 4,373,459 in that each successive stitch pattern of the predetermined string of patterns making up the compound stitch pattern is not influencable by a separately introduced modifying factor, but rather, a single parameter may be introduced by operator depression of input switches 110, 120 for incrementing or decrementing respectively a modifying factor which selected factor may be displayed as at 130, and each pattern of the predetermined string is flagged whether or not and how to be modified in accordance with the single operator entered parameter.

Figure 2:
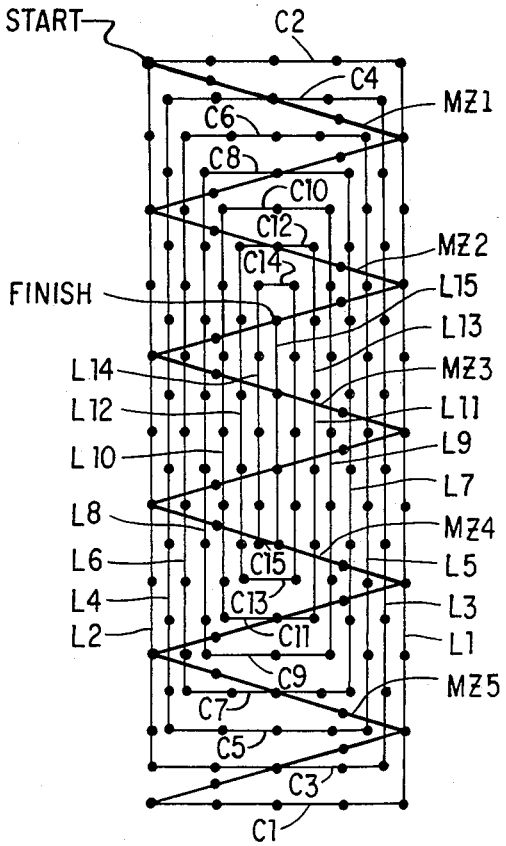
FIG. 2 is a diagram illustrating the stitches in a compound stitch pattern in accordance with this invention.
Figure 3:
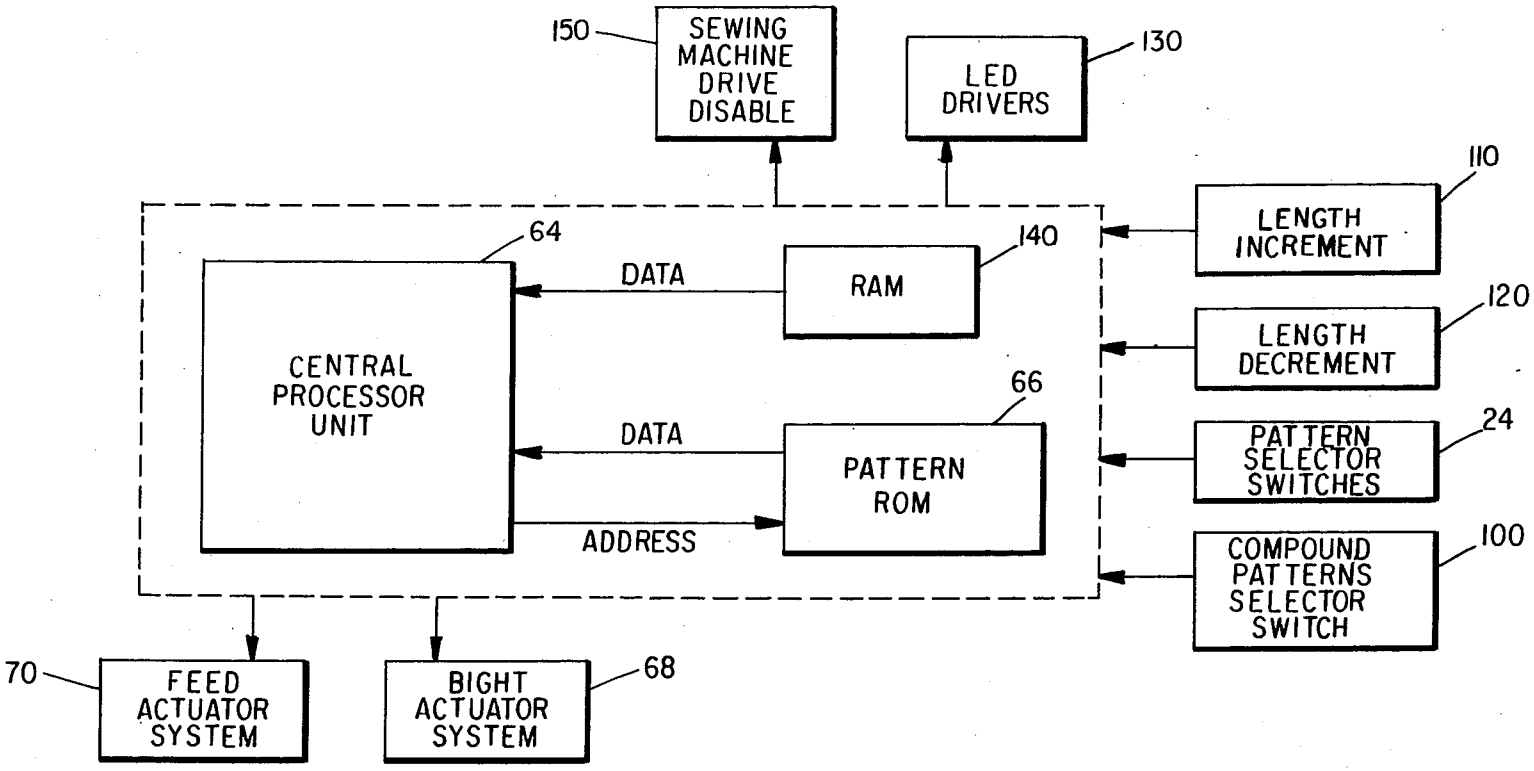
FIG. 3 illustrates a general block diagram of a microcomputer based control system for a sewing machine capable of implementing a compound stitch pattern in accordance with this invention.

A specific preferred example of the present invention will now be described with reference to FIG. 2 which illustrates a compound stitch pattern adapted to serve as a mending stitch pattern for repairing a fabric tear.

The sequence of successive stitch patterns which is entered in the sewing machine pattern memory 66 by depression of the compound pattern selector switch 100 and the enter button 48 comprises a multi stitch zigzag pattern designated MZ. followed by a succession of fourteen (14) transverse straight stitch patterns with no work feed designated C. alternating each with one of fifteen (15) lengthwise straight stitch patterns designated L.

In this preferred embodiment providing a mending stitch pattern the operator influenced input switches 110 and 120 increase or decrease, respectively a parameter related to the length of the fabric tear which it is desired to repair. The parameter to be entered may, for instance, be the length of the tear expressed in millimeters and the entered parameter may be exhibited by the LEDs 130 shown in FIG. 1.

Those of the stitch patterns in the string of patterns stored by depression of switches 100 and 48 which require response to the parameter stored as a result of operation of the input switches 110, 120 as, for instance, in RAM 140 of the microprocessor, are flagged for such response and are associated with data to be processed by the central processor unit 64.

The multi zigzag stitch pattern MB, for instance, is flagged and associated with data related to the length of each multi stitch zigzag pattern by which the central processor unit can calculate and activate an appropriate number of pattern repeats for the MZ pattern to extend the length of the fabric tear as indicated by the operator inserted parameter. FIG. 2 indicates five such repeats for the multi stitch zigzag pattern MB.

The transverse straight stitches produced by each of the stitch patterns indicated by the reference character C need not respond to the operator inserted parameter since the overall width of the mending stitch pattern is the same regardless of the length of the fabric tear. The transverse straight stitch patterns C, therefore, are not flagged for response to the inserted parameter, but instead they are accompanied by predetermined instruction to shift the bight actuator system 68 either left or right and with the appropriate bight termination. The first two, C1 and C2, being at the widest bight of the multi stitch zigzag pattern MZ, and the remainder decreasing in bight, preferrably in uniform steps to the central needle position of stitch pattern C15.

The lengthwise stitch patterns L are flagged to respond to the operator inserted parameter so that the first, L1, will include sufficient stitches so as to extend over the initial multi stitch zigzag pattern MZ 1. Succeeding lengthwise straight stitch patterns each with predetermined instructions to the feed actuator system 70 to feed either forward or reverse, are associated with data enabling the central processor unit 64 successively to decrement the number of feed steps, i.e. stitches as compared with that of L1 so that a composite spiral pattern of successively smaller rectangles is stitched by the alternating patterns C and L so as to cover the multi stitch zigzag stitches of the patterns MZ.

As a result, a strong covering of stitches is formed over a fabric tear. It may be practical to limit the length of fabric tear which can be repaired by any one execution of the compound stitch pattern. in accordance with this invention; and if a longer tear is desired to be mended successive execution of the compound stitch pattern may be used.

Since entry of a parameter is a requisite to proper execution of the compound stitch pattern of this invention, it is desirable for operation of the sewing machine to be prevented in case no such parameter is entered by an operator. Accordingly, the central processor unit 64 of the microprocessor is preferrably arranged to output a disabling signal 150 to the sewing machine drive in the absence of operator insertion of a fabric tear length.

We claim:

1. An electronically controlled sewing machine having stitch pattern memory capable of storing information relating to a plurality of different stitch patterns, means for storing stitch pattern information in said stitch pattern memory relating to a plurality of different stitch patterns, and means for responding to said stored stitch pattern information to produce said plurality of different stitch patterns in a predetermined sequence, the improvement comprising means for uniting said plurality of different stitch patterns into an operator influenced compound mending stitch pattern adapted to close a fabric tear including memory means for storing an operator entered parameter related to the length of the fabric tear to be closed, a central processor unit for effecting unique modification of selected ones of said different stitch patterns in relation to said operator entered parameter, first data stored in association with at least one of said different stitch patterns in said stitch pattern memory, said first data providing a factor enabling said central processor unit to calculate and influence a proper number of repeated stitching of said at least one stitch pattern so as to extend said length of the fabric tear to be closed, and second data stored in association with at least one other of said different stitch patterns in said stitch pattern memory, said second data providing a factor enabling said central processor to calculate and influence an appropriate number of successive stitches in said other pattern so as to extend a length having predetermined relation to that of said fabric tear to be closed.

2. The sewing machine according to claim 1 in which said string plurality of different stitch patterns stored in said stitch pattern string memory comprise a multi stitch zigzag stitch pattern with associated first data stored therewith enabling said central processor unit to influence an appropriate number of pattern repeats to extend the length of the fabric tear to be closed, and in which the remaining stitch patterns stored in said stitch pattern string memory comprise a series of straight stitch patterns extending alternately across and lengthwise with respect to the fabric tear, and including associated second data enabling said central processor unit to influence an appropriate number of stitches therein.

* * * * *